United States Patent [19]

Kobayashi et al.

[11] 4,083,220

[45] Apr. 11, 1978

[54] SUB-ZERO TEMPERATURE PLASTIC WORKING PROCESS FOR METAL

[75] Inventors: Masaru Kobayashi, Tokyo; Atsuya Kamada, Kamakura; Takao Terabayashi; Hiroshi Asao, both of Yokohama, all of Japan

[73] Assignee: Hitachi, Ltd., Tokyo, Japan

[21] Appl. No.: 678,933

[22] Filed: Apr. 21, 1976

[30] Foreign Application Priority Data

Apr. 21, 1975 Japan ..... 50-47566
Apr. 24, 1975 Japan ..... 50-49178

[51] Int. Cl.[2] ..... B21D 31/00

[52] U.S. Cl. ..... 72/364; 72/700; 148/11.5 F; 148/125

[58] Field of Search ..... 72/42, 286, 342, 364, 72/700; 148/11.5 R, 11.5 A, 11.5 F, 125

[56] References Cited

U.S. PATENT DOCUMENTS

| | | | |
|---|---|---|---|
| 2,165,056 | 7/1939 | Kalischer | 148/125 X |
| 3,337,372 | 8/1967 | Reed-Hill | 148/125 X |
| 3,568,491 | 3/1971 | Bruner et al. | 148/125 X |
| 3,653,250 | 4/1972 | Collins | 72/364 |
| 3,661,655 | 5/1972 | Hrusovsky | 148/125 X |

FOREIGN PATENT DOCUMENTS

| | | | |
|---|---|---|---|
| 915,832 | 1/1963 | United Kingdom | 148/125 |
| 1,239,473 | 7/1971 | United Kingdom | 72/364 |

OTHER PUBLICATIONS

"Ice as a Lubricant", Metalworking Production, p. 9, Feb. 8, 1961.

*Primary Examiner*—E. M. Combs
*Attorney, Agent, or Firm*—Birch, Stewart, Kolasch & Birch

[57] ABSTRACT

Improvements in a plastic working process for face-centered cubic metals, and titanium and zirconium having close-packed-hexagonal lattice, which process utilizes a phenomenon that the ductility of these metals is increased at sub-zero temperatures, i.e., temperatures below 0° C. This process includes the steps of (i) imparting plastic flow including at least a uniaxial tensile stress field a metal at a temperature below zero, (ii) subjecting the metal to plastic flow to an extent that the strain of the metal is within the limit of uniform elongation of the metal, and then to plastic flow including at least a uniaxial tensile stress field continuously thereafter, or (iii) using frost as a lubricant for plastic working at temperatures below 0° C according to either one of the foregoing steps.

2 Claims, 46 Drawing Figures

(a)

(b)

(c)

SUB-ZERO TEMPERATURE PLASTIC WORKING PROCESS FOR METAL

BACKGROUND OF THE INVENTION

This invention relates to a process for plastic working of metals, particularly all face-centered cubic metals, and titanium and zirconium having close-packed hexagonal lattice.

Hitherto, it has been a common practice to use temperature in the neighborhood of room temperature or temperatures thereabove for plastic working of all face-centered cubic metals, and titanium and zirconium having close-packed hexagonal lattice. However, plastic working of these metals at temperatures above room temperature improves the workability due to an increase in ductility but lowers the strength of metals after working. On the other hand, the plastic working of these metals at temperatures in the neighborhood of room temperature does not allow hard working from viewpoint of workability. As a result, according to the prior art plastic working, failure to provide sufficient strength is compensated for by improving the configuration of a product, or a decrease in ductility is eliminated by heat treatment, thereby necessitating a design change and an increase in working man hours, with the resulting considerable limitation on the design of a product.

SUMMARY OF THE INVENTION:

It is a principal object of the present invention to provide a process for plastic working of all face-centered cubic metals, and titanium and zirconium having close-packed hexagonal lattice, in which the ductility of such metals is improved so as to widen their working limits and at the same time decrease in working man hours as well as working of a product of a complex configuration become possible.

According to one aspect of the present invention, the aforesaid object may be readily attained in a process for sub-zero temperature plastic working of at least a uniaxial tensile stress field to the aforesaid metal in a sub-zero temperature range of 0° C to -200° C.

According to another aspect of the present invention, there is provided a process for plastic working of the metal, in which the metal is subjected to a plastic flow to an extent that the strain to be caused in the metal at room temperature will fall within a limit of uniform elongation of the metal, after which the metal is subjected to sub-zero temperature plastic working at a temperature below 0° C without interruption.

According to still another aspect of the present invention, there is provided a process for plastic working of the metal, in which the sub-zero temperature working as used in the above aspects of the present invention is attended with the use of frost serving as a lubricant. According to this process, the plastic working of a metal may be more effectively carried out.

DETAILED DESCRIPTION OF THE INVENTION:

(A) In the case of sub-zero temperature plastic working alone:

EXAMPLE 1

Figure 1:
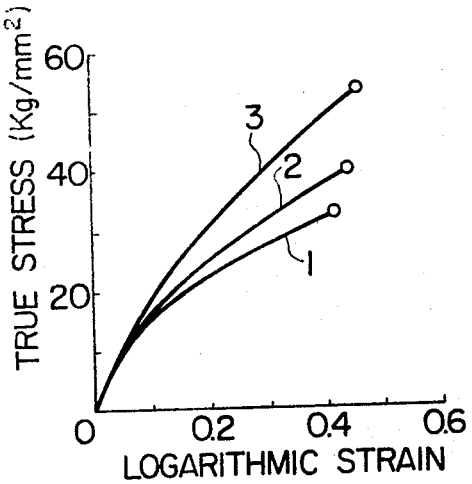
FIG. 1 is a plot illustrative of the influence of deformation temperature of copper annealed pieces on their deformation resistance curve.
Figure 2:
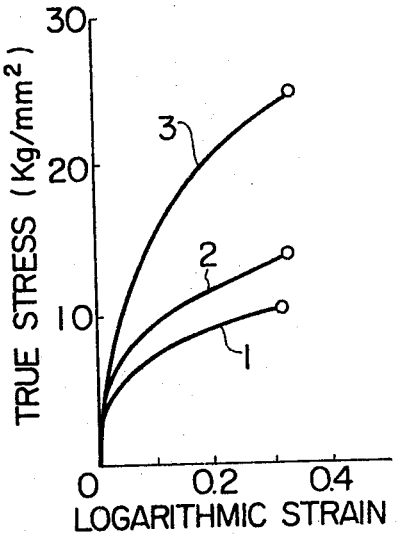
FIG. 2 is a plot showing the influence of deformation temperature of aluminum annealed pieces on their deformation resistance curve.

In case the aforesaid metals are plastic worked, if the working temperature is lowered from room temperature to a sub-zero temperature i.e., temperatures below 0° C, then the ductility and strength of the metals will be increased. This will be described in more detail hereunder:

FIGS. 1 and 2 are stress-strain diagrams representing temperatures as parameter, which diagrams are obtained from tensile tests of copper and aluminum, both of which are face-centered cubic metals.

In these figures, curves 1, 2, and 3 represent the results of tests, when the deformation temperatures were +20° C, −75° C and −196° C, respectively.

As can be seen from the figures, as the working temperature is being lowered for copper and aluminum, then the degree of work hardening will be increased, with the resulting increase in strength. In addition, this suppresses the occurrence of necking, i.e., local deformation, and increases uniform deformation, as well as degree of deformation leading to rupture.

Figure 3:
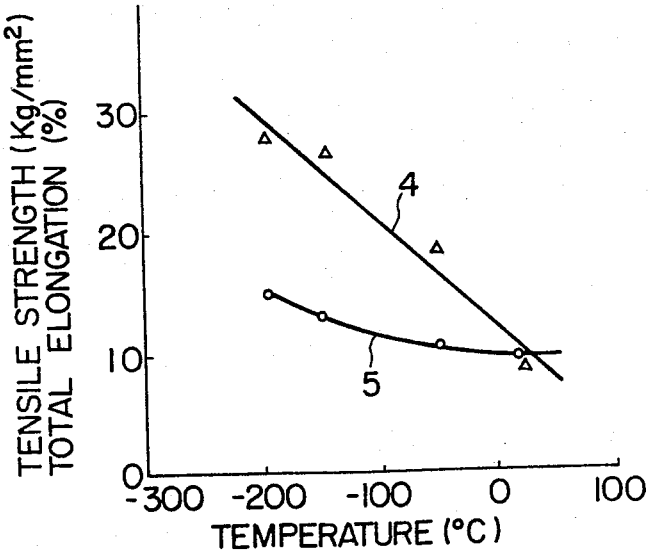
FIG. 3 is a plot illustrative of the relationship of the mechanical properties of industrial pure aluminum worked pieces to a deformation temperature.

FIG. 3 is a diagram showing the relationship between the tensile strength (curve 4) plus total elongation (curve 5), and the deformation temperature of industrial pure aluminum worked pieces (Japanese Industrial Standard A1050).

This figure reveals that as the deformation temperature is being lowered, the tensile strength, i.e., strength, and the total elongation, i.e., ductility will be increased.

Figure 4:
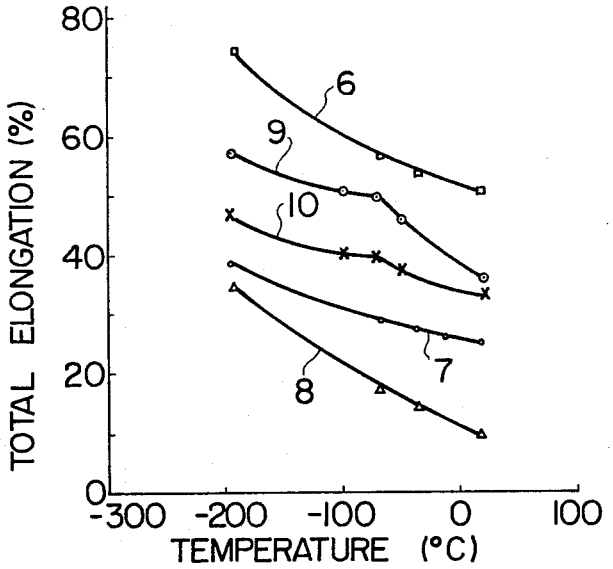
FIG. 4 is a plot showing the relationship between the total elongations of 6–4 brass, phosphor bronze, corrosion resistant aluminum alloys, titanium and zirconium and their deformation temperatures.

FIG. 4 is a plot showing the sub-zero temperature effects on 6–4 brass (curve 6), phosphor bronze (curve 7), corrosion resistant aluminum alloy (JISA5052) (curve 8), which are alloys of face-centered curbic metals, and on titanium (curve 9) which is a close-packed hexagonal metal.

FIG. 4 shows that the total elongation is increased at a sub-zero temperature in the cases of these metals.

It follows from this that the face-centered cubic metals and close-packed hexagonal metals present increased strength and ductility at a sub-zero temperature, as compared with those obtained at room temperature.

Meanwhile, if the aforesaid metals are subjected to deformation at temperatures below 0° C, then work hardening will be enhanced as the temperature is being lowered, as has been described earlier. This is because a slip mechanism at the time of sub-zero temperature deformation differs from that of room-temperature deformation. Accordingly, the status of dislocation internal of the metal, when the temperature is restored to a room temperature after sub-zero temperature deformation, is considered to be different from that after room-temperature deformation. Therefore, it is expected that there results a difference in strength between a metal which has been brought to room temperature after being subjected to some degree of deformation at sub-zero temperature, and a metal which has been subjected to the same degree of deformation as that of the former at room temperature.

Figure 5:
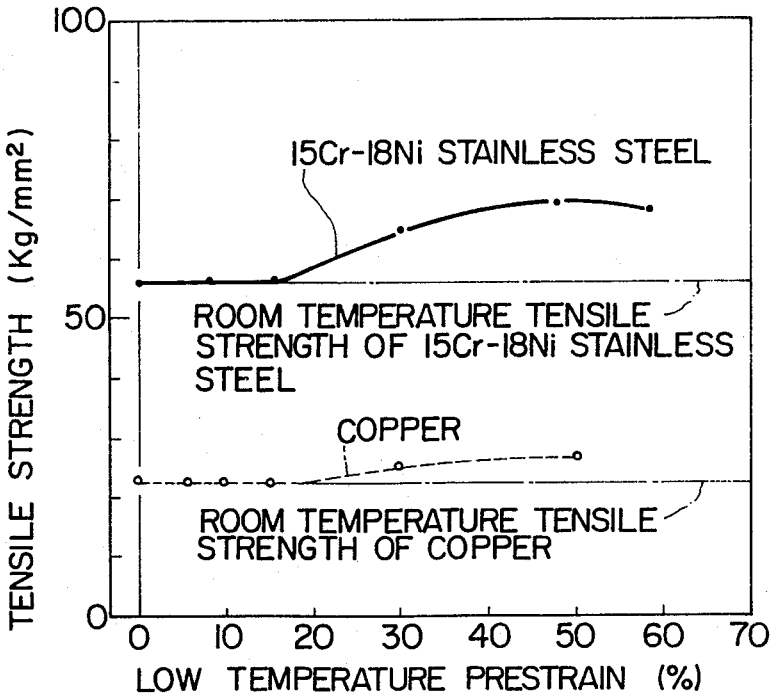
FIG. 5 is a plot showing the relationship between the low temperature prestrains and tensile strength, when copper and 15 Cv-18 Ni stainless steel wires are given prestrain at low temperatures of −150° C and −100° C, respectively, and the percent of total reduction of area, when subjected to tensile deformation at room temperature.

FIG. 5 proves this fact for 15 Cr-18 Ni stainless steel and pure copper, under the condition of uniaxial tension. In this figure, the tensile strength at room temperature is represented by an ordinate, while the prestrain resulting from the tension at a sub-zero temperature is represented by an abscissa. In addition, the prestrain was given to a stainless steel at a temperature of −100° C, and to pure copper at a temperature of −150° C, respectively.

FIG. 5 reveals that, in either case, as the prestrain given at a sub-zero temperature is being increased, the strength at room temperature is being increased, when a worked metal is brought to the room temperature. This in turn reveals that the strength of a product obtained according to the sub-zero temperature working process of the invention is increased as compared with that of a metal worked at room temperature.

The forming limit for plastic working depends on the ductility, tensile strength or buckling resistance of a worked portion of a metal which includes at least a uniaxial tensile stress field. As a result, as can be seen from the results of uniaxial tension tests described, as the working temperature is being lowered, the forming limit for plastic working will be improved.

The plastic working process according to the present invention is based on the results of the aforesaid tests, and is characterized in that the forming limit imposed by or arising from cracks in a worked portion of a metal, which portion includes at least a uniaxial tensile stress field, or the forming limit imposed by or arising from buckling is improved in the plastic working of the aforesaid metals by bringing a working temperature to below 0° C, with the resulting increase in strength of a product after forming.

The plastic working according to the sub-zero temperature working process of the invention will be described by referring to an example thereof, hereinafter.

EXAMPLE 2

Figure 6A:
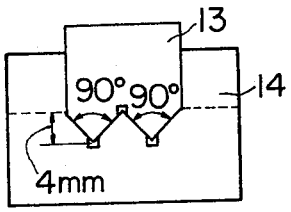
FIGS. 6*a* and 6*b* are views illustrative of a W-form bending die.
Figure 6B:
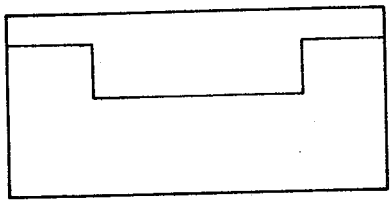
Figure 7:
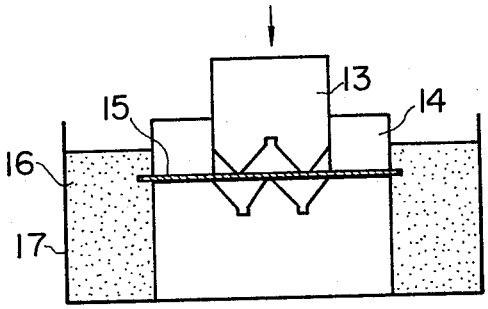
FIG. 7 is a view illustrative of a W-form bending process.

Industrial pure aluminum worked pieces (JISA 1050) which are typical of the face-centered cubic metals, were subjected to W-form bending including an uniaxial tensile stress field, with the working temperature being varied from the room temperature to −196° C. FIG. 6 shows the dimensions of a die used for working. The working procedure used, as shown in FIG. 7, is such that a sheet sample 15 is placed between an upper die 13 and a lower die 14, and then they are placed in a cooling vessel 17 which is in turn placed on a press (not shown). Then a refrigerant 16 (for instance, liquid nitrogen in the case of a temperature of −196° C) is poured in the vessel 17 to a depth, at which the sample 15 is immersed therein, and the sample 15 is retained therein until its temperature is lowered to a given temperature. When the sample 15 reaches a given temperature, then the upper die 13 is lowered to press the sample 15 for working. Meanwhile, the working temperature, i.e., −75° C, was obtained by using dry ice and alcohol.

The radius of the W-form apex of the lower die 14, i.e., the minimum bending radius thereof was varied over a range of 0.2 to 1 mm in an increment of 0.1 mm, while the sample sheet 1 mm thick was used for 'W'-form bending, thereby determining the relationship between the minimum bending radius and the working temperature.

Figure 8:
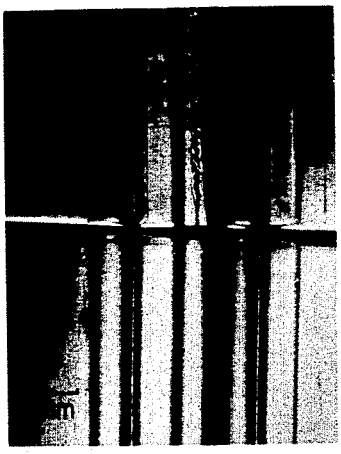
FIG. 8 is photographs showing the results of W-form bending of industrial pure aluminum worked pieces.

FIG. 8 is photographs showing a typical examples of samples used for the aforesaid tests, in which there are indicated a bent portion of a sample 24, which has been worked at a temperature of −196° C and a bent portion of a sample 23 which has been worked at room temperature, with the minimum bending radius of the die being taken as 0.2 mm.

The photographs reveal that the sample worked at room temperature is attended with a crack 25, while the sample worked at a temperature of −196° C is free from a crack, even in the case of bending at the same radius, thus proving the possibility of working.

Figure 9:
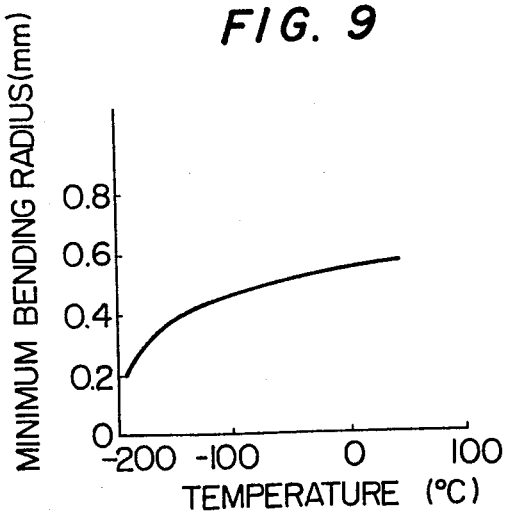
FIG. 9 is a plot showing the relationship between a minimum bending radius and a working temperature of industrial pure aluminum worked pieces.

FIG. 9 is a plot showing the results of tests for the forming limit with the minimum bending radius and working temperature being varied, in which the bending radius is represented by an ordinate, while the working temperature is represented by an abscissa.

FIG. 9 indicates that a decrease in a working temperature from room temperature down to −75° C and −196° C permits a decrease in the minimum bending radius from 0.6 mm to 0.2 mm. This signifies that working into a sharper configuration is possible.

EXAMPLE 3

A sheet 0.15 mm thick, of the same type as that of Example 2 was used for punch bulging which presented a biaxial tensile stress field.

Figure 10A:
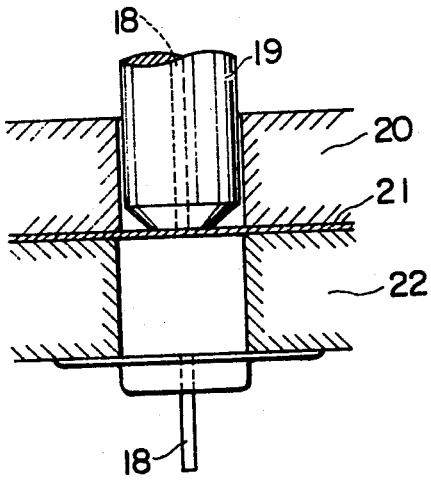
FIGS. 10*a* and 10*b* are views illustrative of the punch-bulging.
Figure 10B:
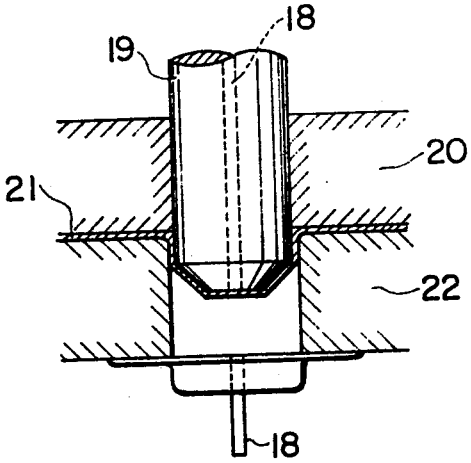

FIG. 10 is a view illustrative of a punch bulging process, in which (a) represents a condition prior to working and (b) a condition after working. A sample or blank 21 was interposed between a blank holder 20 and a die 22, and then held under a blank holder pressure of 1 ton, after which the punch 19 was lowered by a press (not shown) for punching. In case the working temperature of −150° C was to be used, liquid nitrogen was injected through an injection nozzle 18 against the sample, directly, so that the sample 21 may reach a given temperature, after which the sample was subjected to working. Meanwhile, there were used punches 19 having two kinds of diameters of 16 mm and 20 mm, and the limit of bulge height was measured.

Figure 11:
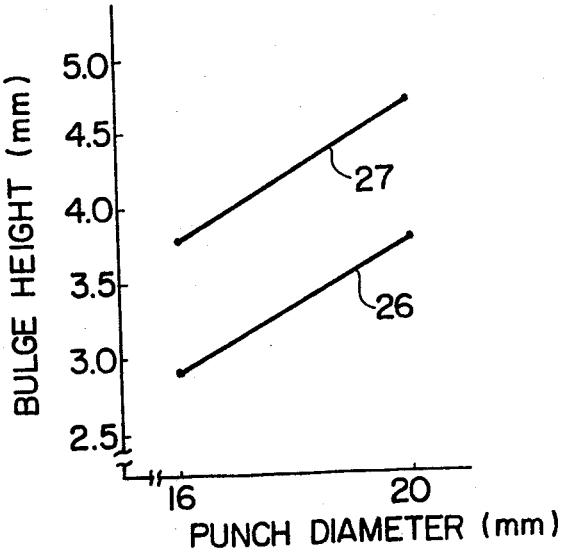
FIG. 11 is a plot showing the relationship between bulge heights of industrial pure aluminum worked pieces and punch diameter.

FIG. 11 shows the results of the above tests, in which the bulge height is represented by an ordinate and a punch diameter is represented by an abscissa, taking a temperature as a parameter. In this figure, a curve 26 indicates working at room temperature (+20° C) and a curve 27 represents working at a temperature of −150° C.

FIG. 11 reveals that the bulge height in the case of working at a temperature of −150° C is improved by 24%, as compared with working at room temperature.

EXAMPLE 4

Figure 12:
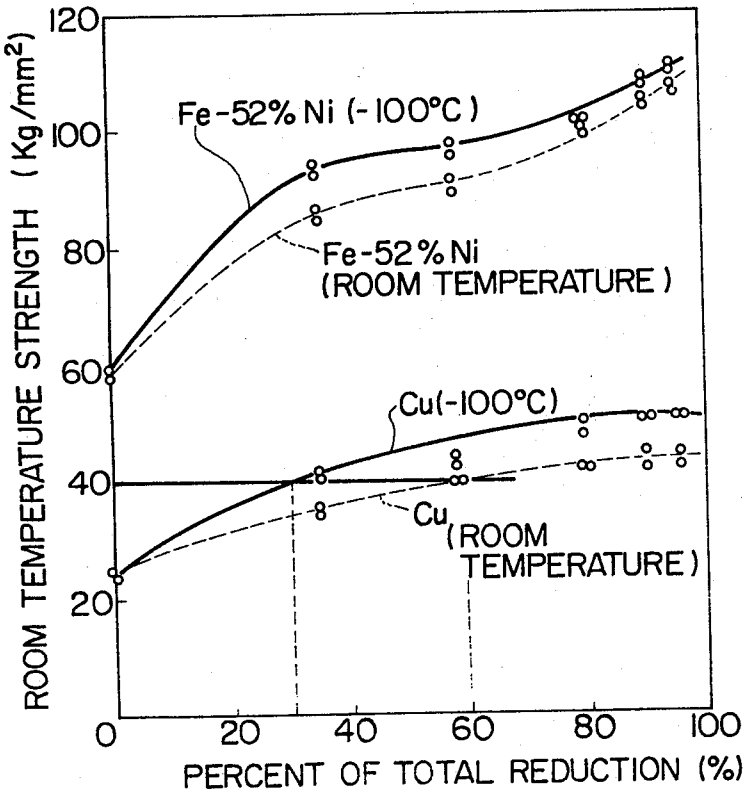
FIG. 12 is a plot showing the relationship between room temperature tensile strength and the percents of total reduction of area of copper and Fe-52% Ni wires, when drawn at room temperature and −100° C.

A pure copper wire and Fe-52% Ni alloy wire of a diameter of 2 mm were drawn at 20% reduction of area per one pass at room temperature and sub-zero temperature (−100° C). The wire drawing speed was 36 m/min. FIG. 12 is a plot showing the relationship between the strength of a metal at room temperature and the percent of total reduction of area thereof.

FIG. 12 reveals that the strength of a metal drawn at a sub-zero temperature is higher than that of a metal drawn at room temperature. Accordingly, the drawing of wire at a sub-zero temperature presents a desired strength at a small working degree. For instance, in case tensile strength of 40 kg/mm$^2$ is required for a copper wire, 60% working is required in the case of room temperature drawing, while only 30% working is required in the case of a sub-zero temperature drawing. In addition, the ductility as well as the strength in such a case are both increased, so that the forming rate per pass may be increased.

As has been described with reference to Examples 2 and 3, if the tensile stress of more than uniaxis is present, the sub-zero temperature working of such a metal may improve its forming limit as compared with the case of room temperature working, as can be expected from the tensile tests shown in Example 1.

As is apparent from the foregoing, the aforesaid sub-zero temperature working of face-centered cubic metal, and titanium and zirconium having close-packed hexagonal lattice, respectively, may prevent cracking and folding by increased ductility and strength in the working processes such as deep drawing, wire drawing, rolling, burring, curling, tube expanding and bulging, all of which tend to cause at least a uniaxial tensile stress field locally, thereby improving the forming limit.

(B) In the case of the use of a combination of room temperature plastic working with sub-zero temperature plastic working;

In case face-centered cubic metals and titanium and zirconium having close-packed hexagonal lattice cause rupture due to insufficient ductility during plastic working, then such a rupture may be prevented to some extent according to improved ductility as shown in FIG. 4 due to working at a temperature lower than room temperature. However, it is often found that in the above case, are ruptured due to insufficient ductility in the practical application.

The present invention is directed to avoiding such a shortcoming, and based on the finding that in the case of plastic working of the aforesaid metals, when the working temperature is lowered to a temperature below 0° C in the course of the room temperature plastic working process, there may be achieved improvements in ductility over that obtained according to the prior art. Thus, the application of this finding to the plastic working results in a widened range of the forming limit. In this case, it is preferable that the timing to lower the working temperature to a sub-zero temperature is given after the strain of a metal which is caused by room temperature deformation reaches the state immediately before the limit of the uniform elongation of a metal at room temperature. Such lowering or transient speed of room temperature to sub-zero is not subjected to a specific limitation. However, it is imperative that such transient timing be given when a metal has been completely lowered to a given sub-zero temperature. The foregoing fact will be described in more detail by way of an example hereunder:

EXAMPLE 5

Description will be given of a case where the aforesaid plastic working is applied to burring of a metal, in comparison with the prior art working process.

Figure 13A:
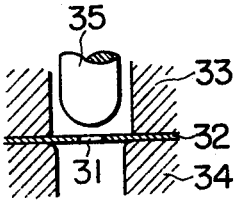
FIGS. 13*a* and 13*b* are views illustrative of a burring process according to the prior art.
Figure 13B:
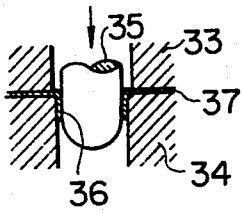
Figure 14A:
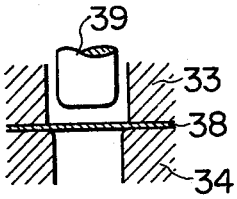
FIGS. 14*a* – 14*d* are views illustrative of a burring process of the prior art, which includes a bulging process.
Figure 14B:
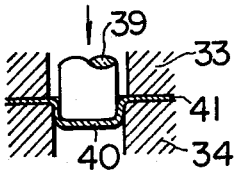
Figure 14C:
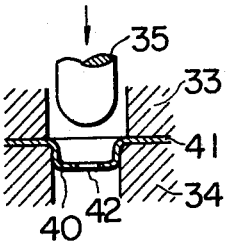
Figure 14D:
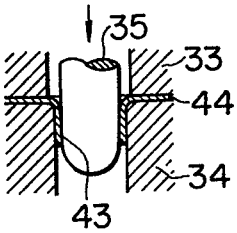
Figure 15A:
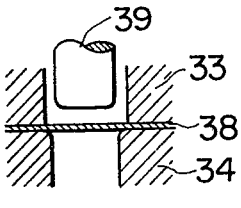
FIGS. 15*a* – 15*e* are views showing a burring process according to the invention.
Figure 15B:
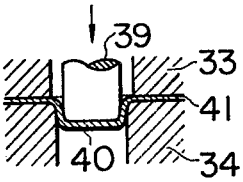
Figure 15C:
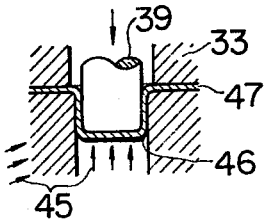
Figure 15D:
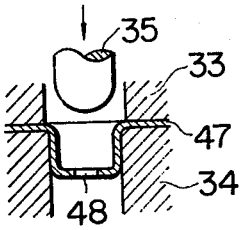
Figure 15E:
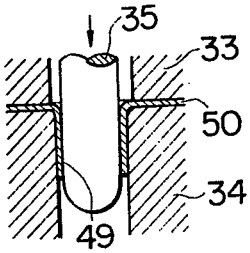

FIG. 13 is views showing the prior art burring process, in which a flat sheet sample 32 having a hole 31 in its center as shown in FIG. 13(a) is interposed between an upper die 33 and a lower die 34, after which the sample is pressed with a round head punch 35 as shown in FIG. 13(b), thereby obtaining a sample 37 having a burring portion 36. In other words, the above process includes a hole-punching and burring steps.

FIG. 14 is views illustrative of the prior art process used for obtaining a greater burring height than that obtained according to the process shown in FIG. 13. As shown in FIG. 14(a), a flat sheet sample 38 is interposed between an upper die 33 and a lower die 34, after which the sample 38 is pressed with a flat head punch 39, thereby obtaining a sample 41 having a bulged portion 40 as shown in FIG. 14(b). Subsequently, as shown in FIG. 14(c), the sample 41 is removed from the die, and then a hole 42 is punched in the center of a bulged portion 40, after which the sample 41 is again placed between the upper die 33 and the lower die 34 for being pressed with a spherical head punch 35, thereby obtaining a sample 44 having a burring portion 43, as shown in FIG. 14(d). In other words, this process includes the steps of bulging, hole-punching, and burring. The aforesaid two types of processes are carried out at room temperature.

FIG. 15 is views illustrative of the burring process according to the present invention. As shown in FIG. 15(a), a flat sheet sample 34 is sandwiched between an upper die 33 and a lower die 34, after which the sample 38 is bulged with a flat head punch 39 at room temperature, thereby obtaining a sample having a bulged portion 40 as shown in FIG. 15(b). Thereafter, as shown in FIG. 15(c), the sample 41 as well as dies 33, 34 are cooled to a given temperature with a cooling medium 45 such as liquid nitrogen and the like, and then the sample is subjected to a bulging step by using a flat head punch 39 at a temperature below zero centigrade, thereby obtaining a sample having a bulged portion 46 of a greater height. Then, as shown in FIG. 15(d), a hole 48 is prepared in the sample 47, and then the sample 47 is pressed with a spherical head punch 35, thereby obtaining a sample 50 having a burring portion 49 as shown in FIG. 15(e). In other words, the above process according to the present invention includes the steps of bulging at room temperature, sub-zero temperature bulging, hole-punching, and burring. According to this process, in the course of a transient phase of bulging from room temperature to sub-zero temperature, there takes place transfer of temperature from a room temperature (about 20° C) to a sub-zero temperature (for instance −100° C), thereby improving the ductility of a metal.

Figure 16:
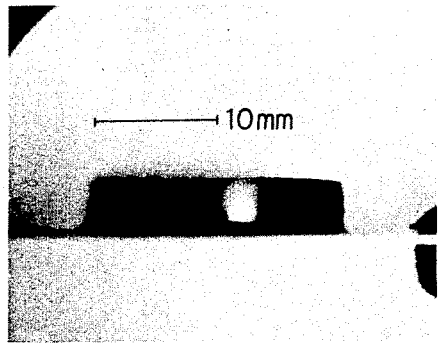
FIGS. 16*a* – 16*c* are outlooks of products which have been produced by applying to 15 Cr-18 Ni stainless steel a burring processes shown in FIGS. 13*a* and 13*b*, 14*a* – 14*d*, and 15*a* – 15*e* respectively.
Figure 16:
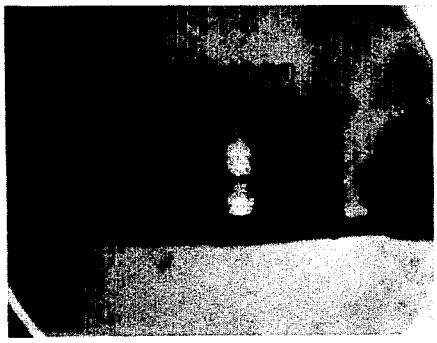
Figure 16:
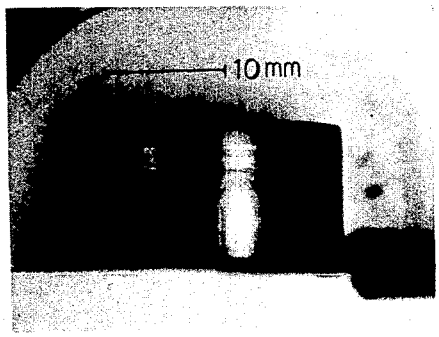

FIGS. 16(a), (b) and (c) are outlooks of products which have been fabricated by subjecting 15 Cr-18 Ni stainless steel to a burring step according to the procedures shown in FIGS. 13, 14, 15, respectively. In this case, the sub-zero temperature bulging was carried out at a temperature of −100° C.

As can be seen from these figures, the product shown in FIG. 15 presents the greatest burring height among these products.

Figure 17:
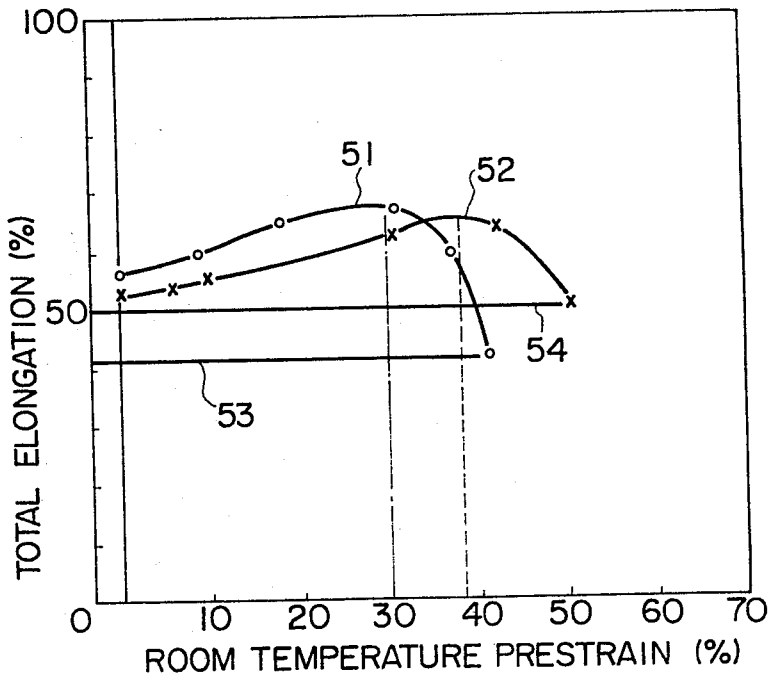
FIG. 17 is a plot showing the relationship between the tensile prestrains of 15 Cr-18 Ni stainless steel and copper at room temperature, and the total elongations thereof.

FIG. 17 is a plot illustrative of an increase in ductility in terms of the total elongation obtained in the uniaxial tensile test. More particularly, FIG. 17 shows the relationship between the total elongation and room temperature prestrain, of the aforesaid 15 Cr-18 Ni stainless steel and pure copper, when these are stretched at room temperature to obtain prestrains and then stretched at temperatures of −100° C and −150° C, respectively. In this figure, a curve 51 and a curve 52 represent the sub-zero temperature total elongations of 15 Cr-18 Ni stainless steel and pure copper, respectively, while curves 53 and 54 represent room temperature total elongations of 15 Cr-18 Ni stainless steel and pure copper, respectively.

As shown, the total elongations of the both materials increase with an increase in prestrain. In other words, an increase of the maximum elongation of 15 Cr-18 Ni stainless steel is about 1.7 times as much as the room temperature elongation, while that of the pure copper is about 1.3 times. In this respect, if the prestrain exceeds the uniform elongation limit, then the total elongation exhibits a decrease. The reason of an increase in ductility may be that there takes place less cross slip in a face-centered cubic metal at a sub-zero temperature, with the resulting increase in work-hardening.

EXAMPLE 6

Figure 18:
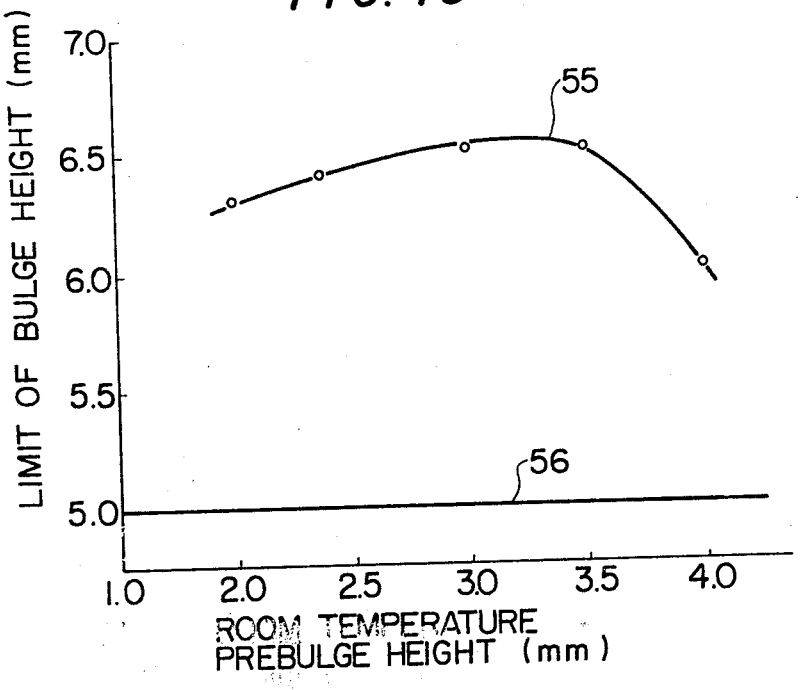
FIG. 18 is a plot showing the relationship between the room temperature prebulge heights of a titanium sheet, when subjected to prebulging at room temperature and then to sub-zero temperature bulging, and the total bulge height.

Description will be turned to the results of a test, in which titanium sheet is subjected to a punch-bulging process in a machine shown in FIG. 10. In this case, a sheet 0.15 mm thick was used as a sample, while a punch of 20 mm in diameter was used, the blank holder pressure being 5 tons. In the case of the prior art process, a punch was lowered at room temperature, and then the limit of bulge height was measured. On the other hand, in the case of the process according to the present invention, the bulge height at room temperature was varied, after which a refrigerant was injected against the sample to lower its temperature from a room temperature to a sub-zero temperature. Then, after the sample had been cooled to a given temperature (−50° C), the sample was subjected to further bulging, and the limit of bulge height was measured. FIG. 18 shows the results of test. In this figure, an abscissa represents a room-temperature prebulge height, while an ordinate represents the limit of a bulge height. A curve 55 indicates the results of a test according to the present invention, and a curve 56 relates to a test according to the prior art.

FIG. 18 reveals that the bulge height is increased according to the present invention, as compared with the prior art.

The above results refers to titanium while the same results may be obtained for zirconium of a close-packed hexagonal metal.

Figure 19:
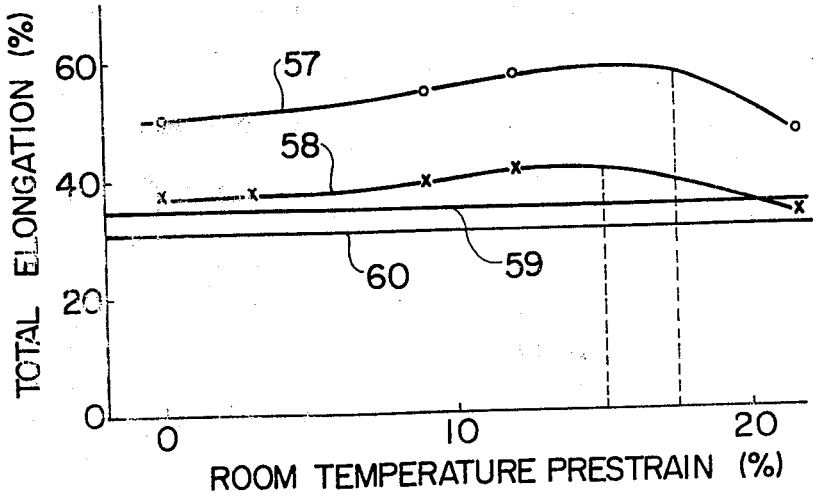
FIG. 19 is a plot illustrative of the relationship between the total elongation and the room temperature prestrain of a zirconium plate, when given a prestrain at room temperature, and then stretched at −50° C.

FIG. 19 is a plot showing an increase in ductility in terms of the total elongation obtained in a uniaxial tensile test. In this figure, there is shown a relationship between the total elongation and the room temperature prestrain of metals which have been subjected to stretched at room temperature to obtain prestrains, and then stretched at a temperature of −50° C. Curves 57, 58 are associated with the results of titanium and zirconium, respectively, while curves 59, 60 represent the levels of room temperature total elongations of titanium and zirconium, respectively.

As shown, prestrains of the both materials increase with an increase in total elongation. More specifically, the maximum elongation of titanium at room temperature is about 1.6 times as much as that at room temperature, while that of zirconium is about 1.3 times. If the prestrain exceeds the limit of uniform elongation, then the total elongation is decreased. As in the case of face-centered cubic metal, less cross slip at a sub-zero temperature is responsible for the aforesaid increase in ductility, so that the degree of work hardening is increased, leading to uniformity of strain.

When the process according to the present invention, which utilizes a combination of a room temperature working with a sub-zero temperature working is applied to the practical plastic working, there may be achieved advantages as follows:

(1) The sub-zero temperature working subsequent to the room temperature working results in an increase in ductility of a metal, as well as in improvement in plastic workability. This in turn improves the forming limit and permits the working to an increased extent. For instance, if there is used a combination of room temperature working with sub-zero temperature working, then the forming limit of 15 Cr-18 Ni stainless steel raised by about 1.7 times as high as that obtained by the room temperature working, while that of titanium is raised by about 1.6 times as high as that obtained at the room temperature working, respectively. (See FIGS. 17 and 19.)

(2) Feasibility of working to an increased extent, i.e., hard working results in reduction in number of parts required for the fabrication of a product, with the accompanying reduction in cost of a product.

Meanwhile, the process according to the present invention may be applied not only to the aforesaid working processes but also to the plastic working having at least a uniaxial tensile stress field. For instance, the bending radius may be lessened in the case of bending. In addition, an increase in a limiting drawing ratio, and prevention of wrinkles as well as rupture at the corners of a bottom of a blank in the case of a drawing process may be achieved, while an increase in percent of reduction of area and improvement in the limiting working percent and the like are also achieved.

(C) In the case of the use of frost as a lubricant:

Description will be given of the case where the sub-zero temperature working uses frost as a lubricant for the face-centered cubic metals and titanium and zirconium having close-packed hexagonal lattice.

It has been a common practice in the case of plastic working of metals that a lubricant optimum for a metal concerned is selected for reducing the frictional coefficient prevailing between dies and a material to be worked. Included by lubricants which have found their use in such an application are solid type lubricants, i.e., molybdenum disulfide, soap, graphite and the like, and liquid type lubricants such as oils and fats, mineral oil, vegetable oil and so forth. However, difficulty is encountered with the selection among these, while there arises a shortcoming in removal of lubricant after working. In addition, still another problem is posed, in which dies should be cooled so as not to be heated in the case of a continuous working for a long period of time. Accordingly, it has been desired to have a process which dispenses with the use of a prior art lubricant as well as with the removal of a lubricant after working, and which does not need cooling of dies.

Meanwhile, in the case of the aforesaid sub-zero temperature working, if a material cooled to a temperature below zero is exposed to air, then there is produced frost on the surface of the material due to the condensation of moisture in air. When the plastic working is carried out by using such frost as a lubricant, then there results not only an increase in ductility but also improvement in workability of the material. Description will now be given of the advantages of the use of frost as a lubricant, hereunder.

Figure 20:
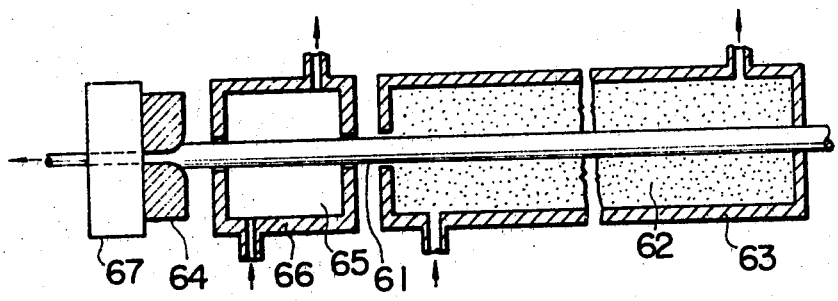
FIG. 20 is a view illustrative of an apparatus for wire drawing using frost lubrication.
Figure 21:
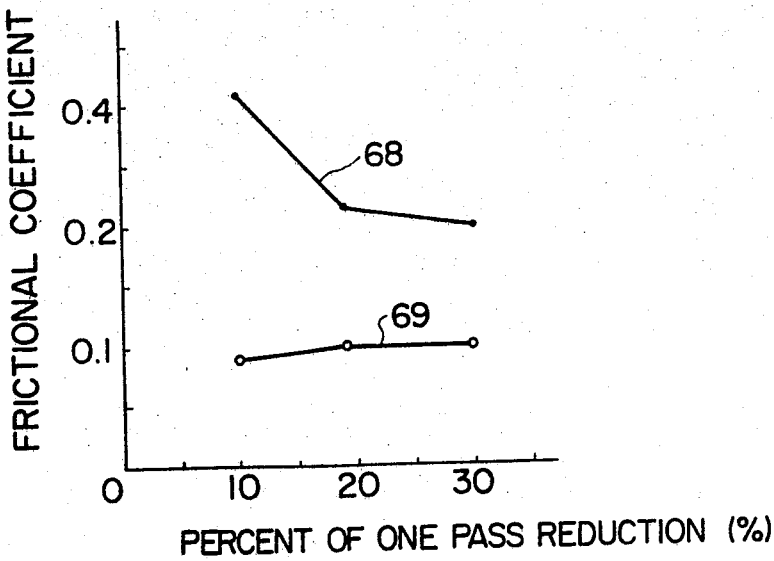
FIG. 21 to FIG. 24 are plots illustrative of the relationship between the frictional coefficients and the percents of one-pass reduction of area of Fe-52% Ni alloy wire, Be-Cu alloy wire, Ag-Cu alloy wire and titanium wire, respectively, when drawn according to the process of the invention using frost lubrication and the process of the prior art.
Figure 22:
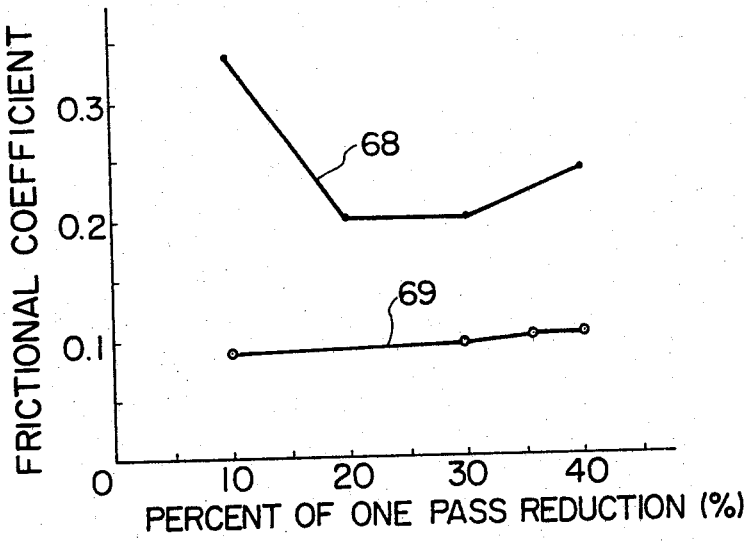
Figure 23:
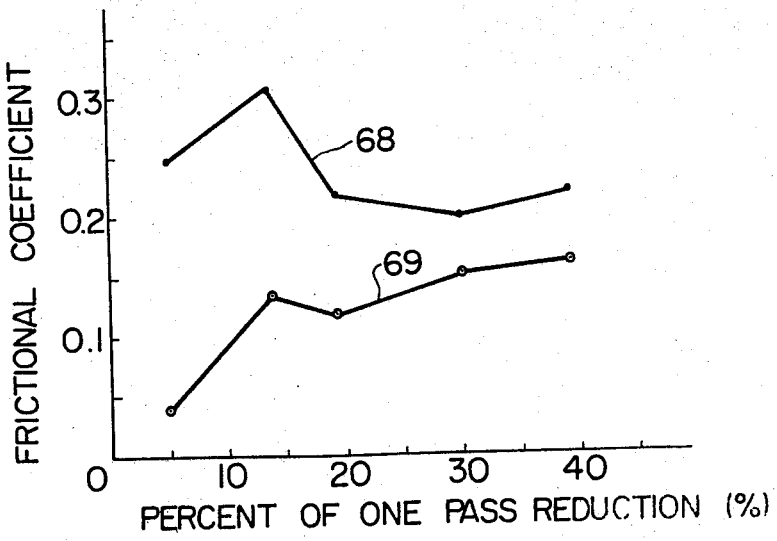
Figure 24:
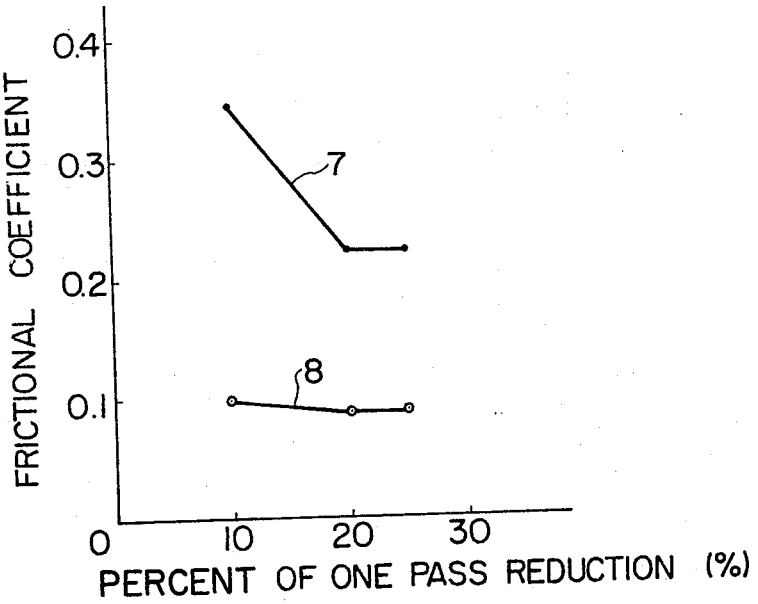

FIG. 20 shows an apparatus for wire drawing using a frost lubricant. As shown, a material 61 to be worked is passed through a cooling vessel 63 whose interior has been cooled with a refrigerant 62 such as liquid nitrogen, after which the material is drawn through a die 64. In this respect, frost produced on and clinging to the surface of the material during the travel of the material from the cooling vessel 63 to the dies 64 is used as a lubricant. The drawing temperature for the material 61 to be drawn is adjusted according to the temperature of the cooling vessel 63 and a distance between the cooling vessel 63 and the dies 64, and also the clinging quantity of frost is controlled by a distance between the cooling vessel 63 and the dies 64 or by means of a moisture-adjusting vessel 66, through which air 65 having moisture adjusted is flowing and which is placed between the cooling vessel 63 and the dies 64. The drawing force may be determined by means of a load cell attached to the dies 64.

EXAMPLE 7

Comparison will be made between the results of the drawing according to the present invention, which uses the apparatus for wire drawing of FIG. 20 and the results of drawing according to the prior art.

FIGS. 21 to 24 show the relationship between the frictional coefficient and the percent of one pass reduction of area, when a Fe-52% Ni alloy wire (annealed), Be-Cu alloy wire (as worked), Ag-Cu alloy wire (50% worked) and a titanium wire (annealed) which all have a diameter of 1.5 mm, are drawn at a drawing speed of 36 m/min. Throughout these figures, a curve 68 represents the results of the prior art process, while a curve 69 represents the results of the process according to the present invention. In this case, the moisture-adjusting vessel 66 was not used and the distance between the cooling vessel 63 and the dies 64 was held at 50 cm in the apparatus of FIG. 20. In this respect, the drawing temperature of −100° C was used for the wires except for a titanium wire, while a drawing temperature of −190° C was used for a titanium wire.

These figures reveal that in any of the cases, the process according to the present invention presents a decrease in frictional coefficient to a large extent, as compared with the prior art process. The reason why the friction coefficient is reduced with an increase in percent of one pass reduction of area is that the friction coefficient tends to be decreased with an increase in a bearing pressure. In contrast thereto, the process according to the present invention maintains a substantially constant friction coefficient when the percent of one pass reduction of area exceed 10%.

Figure 25:
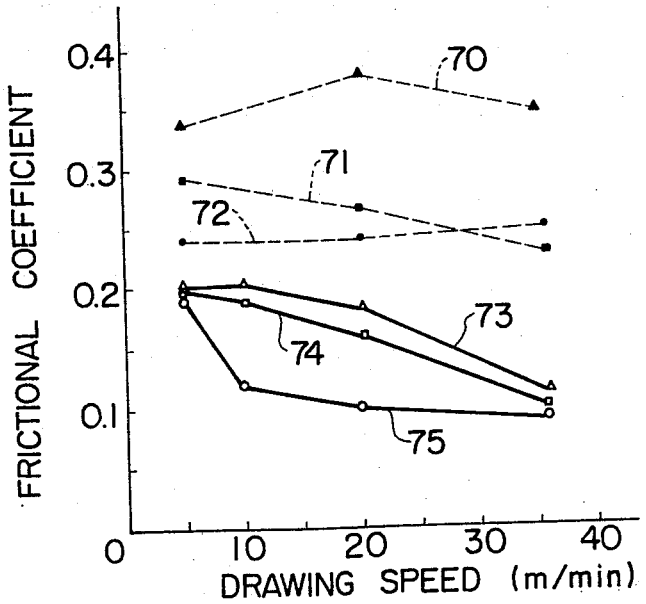
FIG. 25 is a plots showing the relationship between the frictional coefficients and wire drawing speeds of a Fe-52% Ni alloy wire, when drawn according to the processes of the invention and the prior art.

FIG. 25 shows the relationship of the frictional coefficient to the drawing speed of a Fe-52% Ni alloy wire taken as an example. In this figure, curves 70, 71, 72 refer to 10, 19 and 30 percent of one pass reduction of areas, which are obtained according to the prior art process, respectively, while curves 73, 74, 75 are associated with 10, 19 and 30 percent of one pass reduction of areas according to the present invention, respectively.

These figures indicate that a large extent of reduction may be achieved for frictional coefficient in the case of the process according to the present invention, irrespective of a drawing speed, as compared with the process of the prior art. In addition, according to the process of the invention, the friction coefficient is decreased with an increase in drawing speed.

EXAMPLE 8

Figure 26:
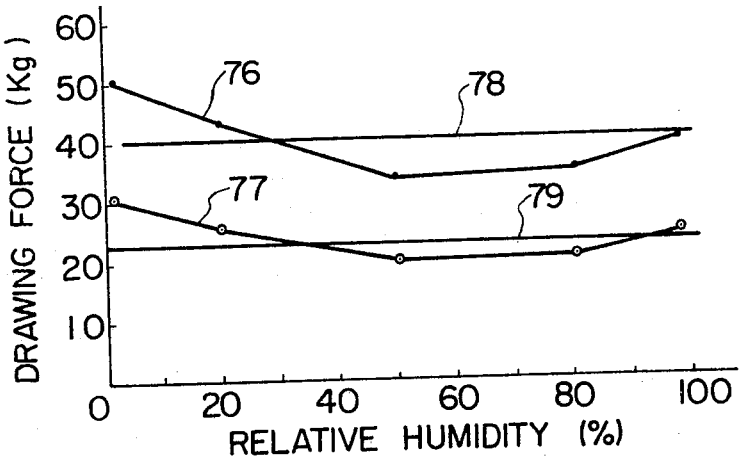
FIG. 26 is a plot showing the relationship between the drawing force and the relative humidity, when a pure copper annealed wire is drawn according to the frost-lubrication drawing process of the invention at a drawing temperature of −100° C at a drawing speed of 5 m/min.

Meanwhile, it is considered that the magnitude of a frictional coefficient depends on the clinging state and amount of frost. FIG. 26 is a plot showing the relationship between the drawing force and the relative humidity when a pure copper wire (annealed) is drawn at a constant drawing speed of 5 m/min. In this figure, there was used the apparatus for wire drawing as shown in FIG. 20 and the temperature within the cooling vessel 63 was maintained at a temperature of −196° C, and in addition the drawing temperature of −100° C was used, while a humidity adjusting vessel 66 was positioned between the cooling vessel 63 and a dies 64, and the relative humidity of air flowing through the vessel 66 was varied. In this figure, curves 76, and 78 refer to 19 and 10 percent of one pass reduction of areas, respectively. In addition, lines 78 and 79 refer to 19 and 10 percent of one pass reduction of areas in the case of the prior art process, respectively. As shown, the drawing force is maintained constant irrespective of humidity, as far as the prior art process is concerned. In contrast thereto, the drawing force according to the process of the invention exhibits a smaller value in the range of relative humidity of 30 to 98%, in either case, presenting a minimum value in the neighborhood of relative humidity of 50%.

Figure 27:
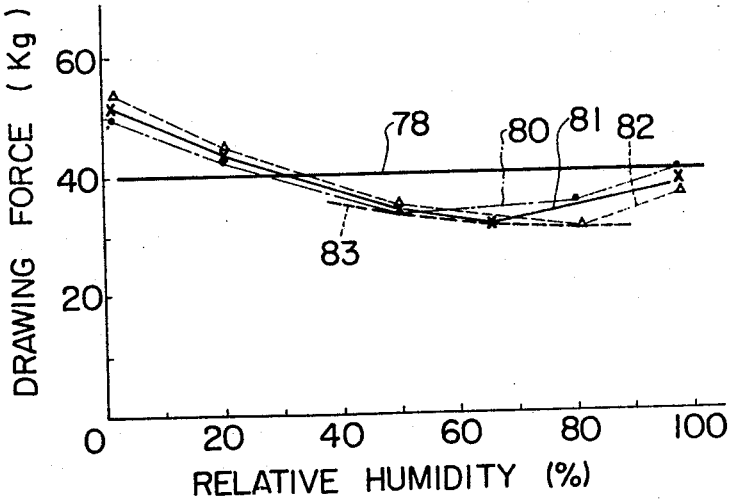
FIG. 27 is a plot showing the relationship between the drawing force and the relative humidity, when a pure copper annealed wire is drawn according to the frost-lubrication drawing process of the invention at a percent of one pass reduction of area of 19%, at varying drawing speeds.

FIG. 27 is a plot showing the relationship between the drawing force and the relative humidity, when a pure copper wire (annealed) is drawn at a constant percent of one pass reduction of area and various drawing speeds, as in the case of FIG. 26, and presenting variation in the minimum drawing force which depends on the variation in relative humidity. In this figure, curves 80, 81, 82 represent the relationship of the drawing force to the relative humidity at a drawing speed of 5, 20, and 36 m/min, respectively. A curve 83 indicates the variation in the minimum drawing forces of the aforesaid three curves. A curve 78 represents the same line as that shown in FIG. 26. The results of this test show that the minimum drawing forces shift to the side of higher humidity, with an increase in a drawing speed, while the drawing force is lowered to some extent.

EXAMPLE 9

Description will now be turned to the results of measurements of a drawing force and the like, when a frost lubricant and an ordinary lubricant are used in combination.

As a drawing material, an annealed copper wire for electrical purpose of a diameter of 1.7 mm was used, while as an ordinary lubricant, molycoat 321 of a molybdenum disulfide base (Dow Corning Company's make, trade name), and soap and G710 of a mineral oil base (Nippon-Kosakuyu Co. Ltd.'s make, trade name) were used. In addition, a drawing machine as shown in FIG. 20 was used for drawing a wire. In this test, a material to be drawn was coated with a lubricant immediately before the entrance of a cooling vessel 63, and there were used a drawing temperature of −150° C and a drawing speed of 5 m/min for measurement. Meanwhile, meant by a non-dimensional drawing force Z/F.Kfm as used herein is a factor corresponding to the friction coefficient. In this respect, Z represents a drawing force (kg), F cross-sectional area of a wire after drawing, $K_{fm} = (K_{f_1} + K_{f_2})/2$ an average deformation resistance (Kg/mm²), $K_{f_1}$ a yield stress (kg/mm²) of a wire at −150° C before drawing, and $K_{f_2}$ a yield stress (kg/mm²) of a wire, after the cross-sectional area of a wire has been reduced.

Figure 28:
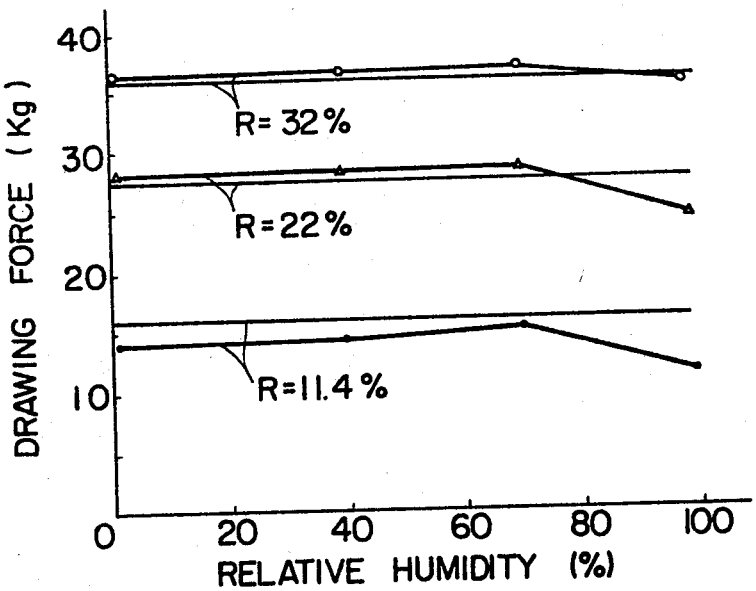
FIG. 28 to FIG. 30 are plots showing the relationship between the drawing force and the relative humidity, when an annealed copper wire for electrical purpose is drawn by using a combination of a frost lubricant with a mineral oil, molybdenum disulfide or soap base lubricant.
Figure 30:
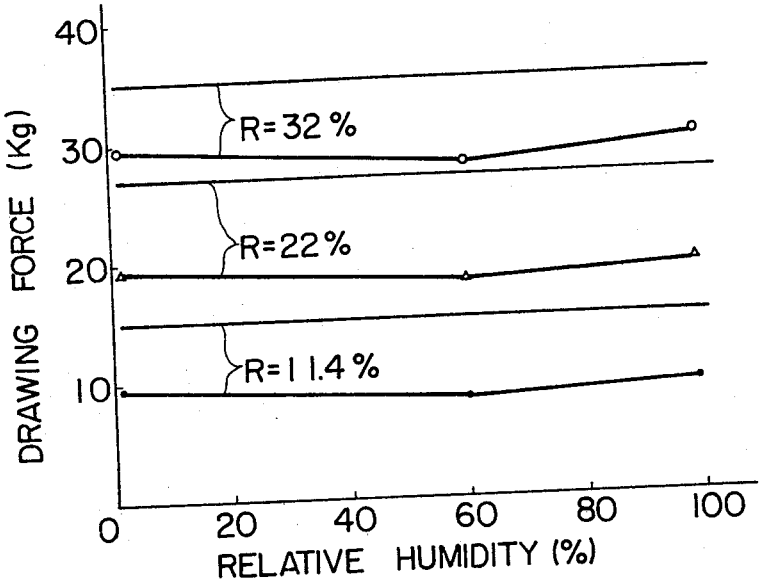

FIGS. 28 and 30 are plots showing the relationship between the drawing force and the relative humidity in the case of the sub-zero temperature working, when a combination of a mineral oil base lubricant, molybdenum disulfide base lubricant and a soap base lubricant were used. In these figures, lines represent the results of a test according to the prior art process (room temperature working) for comparison purposes, while curves represent the results of a test in the case of sub-zero temperature working using a combination of a frost lubricant with an ordinary lubricant. R represents a percent of one pass reduction of area.

As can be seen from FIG. 28, the drawing force remains substantially the same as that obtained in the case of room temperature working over the range of the relative humidity of up to about 70% in the case of the sub-zero temperature working which uses a combination of a mineral oil base lubricant with a frost lubricant. However, when the relative humidity exceeds about 80%, then there may be observed the effect of sub-zero temperature working, i.e., the effect of a frost lubricant, so that a drawing force is somewhat lowered.

Figure 29:
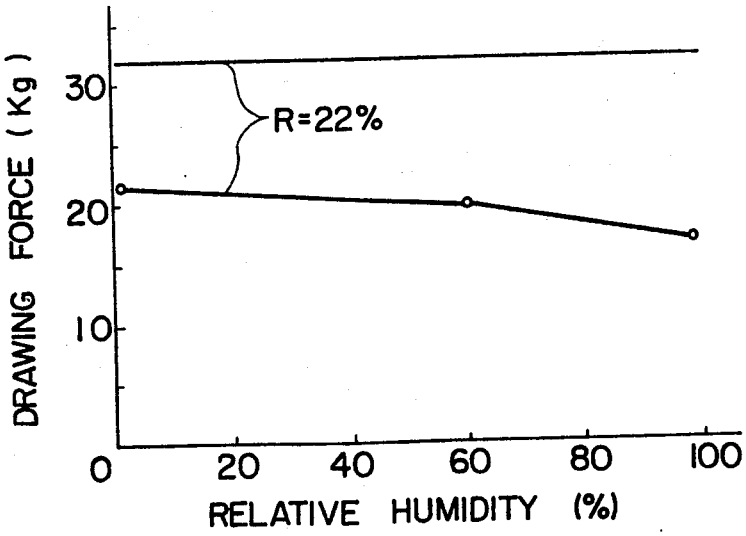

As can be seen from FIG. 29, in the case of the sub-zero temperature working using a combination of a molybdenum disulfide base lubricant with a frost lubricant, a drawing force is found to be lowered even in the case of relative humidity being zero, as compared with the case of room temperature working, while the drawing force is gradually decreased with an increase in relative humidity.

FIG. 30 reveals that in the case of the sub-zero temperature working using a combination of a soap lubricant with a frost lubricant, the drawing force is considerably lowered as compared with the case of the room temperature working, while there is noted little or no influence of relative humidity, i.e., the effect of a frost lubricant.

Figure 31:
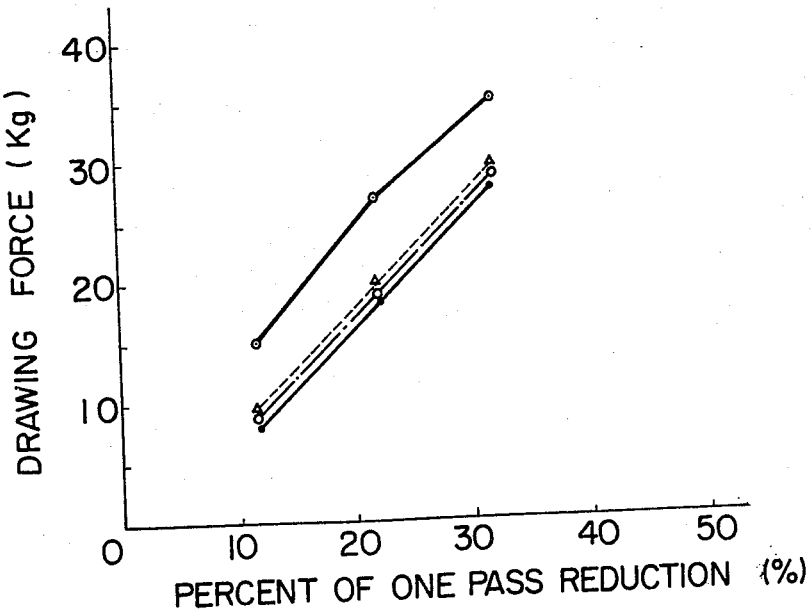
FIG. 31 is a plot showing the relationship between the drawing force and the percent of one-pass reduction of area, when an annealed copper wire for electrical purpose is drawn at a sub-zero temperature by using a combination of a soap lubricant with a frost lubricant, at varying relative humidities, as well as when the soft copper wire is drawn at room temperature by using a soap lubricant.

FIG. 31 is a plot showing the relationship between the drawing force and the percent of one pass reduction of area, comparing the results of a test wherein the sub-zero temperature working was carried out at varying relative humidity of 0, 60, and 100%, by using a combination of a soap base lubricant with a frost lubricant, with the results of a test wherein the room temperature working was carried out by using a soap base lubricant. As seen from this figure, there is noted little or no influence of the relative humidity in the case of the sub-zero temperature working using a soap base lubricant in combination with a frost lubricant, although the drawing force exhibits a considerable decrease, as compared with the case of room temperature working.

Figure 33:
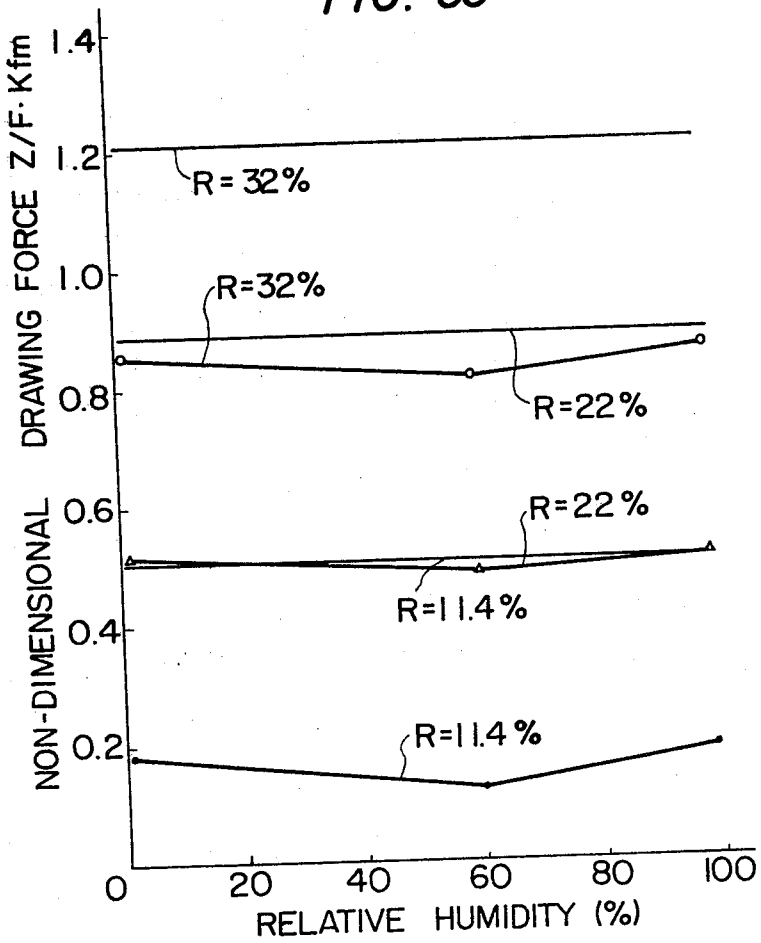
FIG. 32 to FIG. 34 are plots showing the relationship between the non-dimensional drawing force and the relative humidity, when an annealed copper wire for electrical purpose is drawn by using a mineral oil base lubricant, soap base lubricant, or molybdenum disulfide base lubricant and frost lubricant, in combination.
Figure 32:
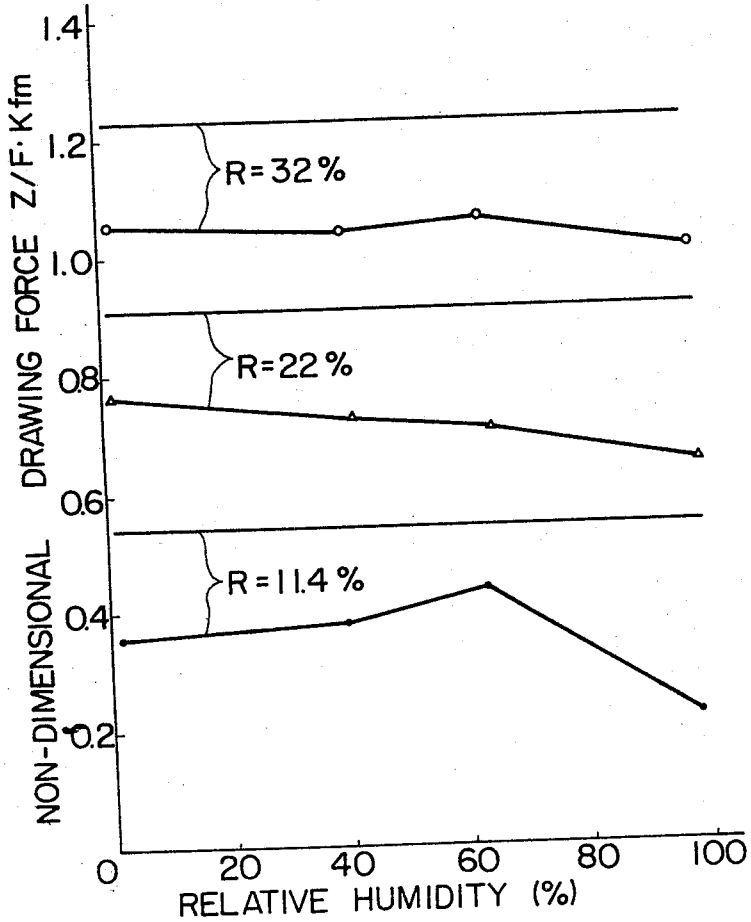
Figure 34:
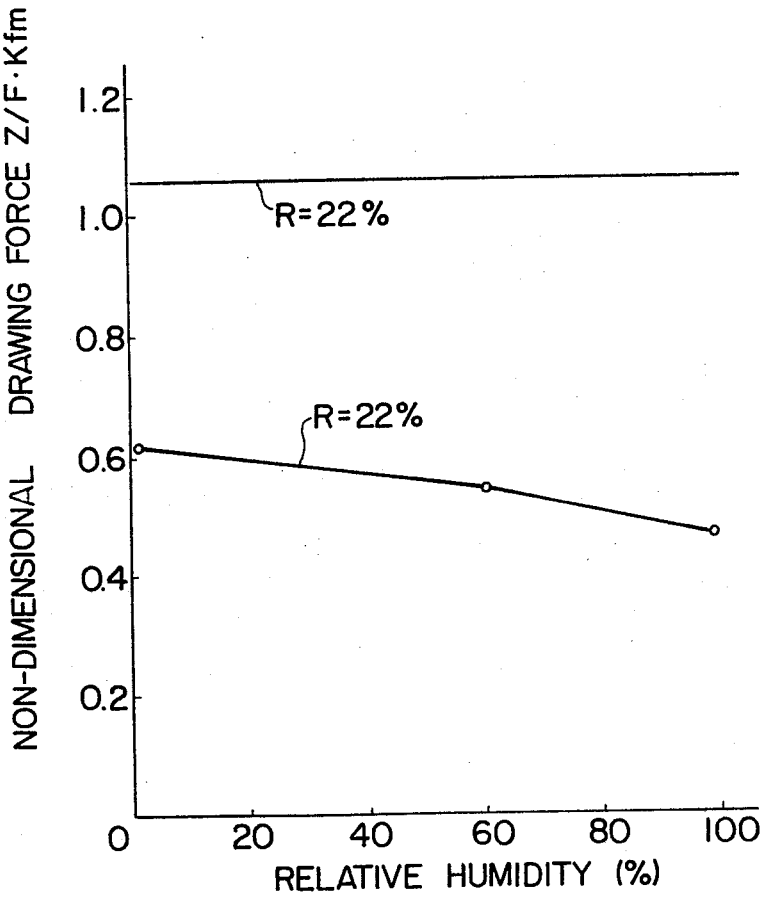

FIGS. 32 to 34 are plots showing the relationship between the non-dimensional drawing force and the relative humidity in the case of the sub-zero temperature working, which uses a combination of a mineral oil base lubricant, soap base lubricant, molybdenum disulfide base lubricant and frost lubricant. In these figures, curves represent the results of the sub-zero temperature working using lubricants in combination, while lines represent the results of the room temperature working using a lubricant given for the comparison purpose.

FIG. 32 shows that the non-dimensional drawing force, i.e., frictional coefficient in the case of the sub-zero temperature working using a combination of a mineral oil lubricant with a frost lubricant is considerably lowered, as compared with the case of room temperature working, while the relative humidity of the former is not varied over the range of up to about 70%, but lowered when exceeding about 80%.

FIG. 33 reveals that the non-dimensional drawing force, i.e., frictional coefficient in the case of the sub-zero working using a combination of a soap base lubricant with a frost lubricant is lowered to a great extent, as compared with the case of the room temperature working, while there is no influence of relative humidity on the former case.

As can be seen from FIG. 34, the non-dimensional drawing force, i.e., frictional coefficient in the case of the sub-zero working using a combination of a molybdenum disulfide base lubricant with a frost lubricant is lowered to a great extent, as compared with the case of the room temperature working, while the frictional coefficient is gradually decreased with an increase in relative humidity, proving the effect of the frost lubricant.

As is apparent from the foregoing description, if a suitable lubricant is selected commensurate to the type of a material to be worked, and the sub-zero temperature working is carried out by using a combination of the aforesaid selected lubricant with a frost lubricant, there may be achieved further improved results.

It should be noted that the frost lubricant according to the present invention may be applied to rolling and the like, while the description has been given of the application to the drawing process of a metal.

We claim:

1. A process for plastic working of a metal, comprising the steps of:

subjecting a metal selected from a group consisting of all face-centered cubic metals, titanium and zirconium having close-packed hexagonal lattice to plastic flow including at least a uniaxial tensile stress field, giving a strain which falls immediately before the uniform elongation limit of said metal at room temperature;

then cooling said metal to a temperature below 0° C; and subjecting said metal to plastic flow including at least a uniaxial tensile stress field at said sub-zero temperature.

2. A process for plastic working of a metal as defined in claim 1, wherein the metal is cooled at a temperature below −50° C.

* * * * *

UNITED STATES PATENT AND TRADEMARK OFFICE

CERTIFICATE OF CORRECTION

PATENT NO. : 4,083,220

DATED : April 11, 1978

INVENTOR(S) : Masaru KOBAYASHI et al

It is certified that error appears in the above-identified patent and that said Letters Patent are hereby corrected as shown below:

IN THE HEADING OF THE PATENT:

Under "[30] Foreign Application Priority Date", insert

--April 6, 1976 Japan 51-37727
April 6, 1976 Japan 51-37728--

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*